United States Patent [19]

Stroud

[11] Patent Number: 4,947,909

[45] Date of Patent: Aug. 14, 1990

[54] PROCESS AND APPARATUS FOR OPTIMIZING VOLUME OF BOARDS CUT FROM A LOG

[75] Inventor: Brian T. Stroud, Richmond, Canada

[73] Assignee: CAE Machinery Ltd., Vancouver, Canada

[21] Appl. No.: 310,776

[22] Filed: Feb. 14, 1989

[51] Int. Cl.[5] ..... B27B 1/00; B27C 9/00

[52] U.S. Cl. ..... 144/357; 83/76.8; 83/364; 83/368; 144/3 R; 144/39; 144/377; 144/378; 356/150; 356/384; 364/561

[58] Field of Search ..... 144/39, 41, 3 R, 356, 144/357, 377, 378, 369, 370; 83/71, 364, 368, 367, 365; 364/561; 356/5, 150, 384

[56] References Cited

U.S. PATENT DOCUMENTS

| | | | |
|---|---|---|---|
| 3,459,246 | 8/1969 | Ottosson | 144/312 |
| 3,692,074 | 9/1972 | Nilsson | 144/39 |
| 3,724,958 | 4/1973 | Callan | 356/160 |
| 3,852,579 | 12/1974 | Sohn et al. | 235/151.3 |
| 4,250,937 | 2/1981 | Detjen | 144/312 |
| 4,264,064 | 4/1981 | Allen et al. | 269/54.1 |
| 4,316,491 | 2/1982 | Kearnes et al. | 144/39 |
| 4,485,861 | 12/1984 | Nilsson et al. | 144/357 |
| 4,548,247 | 10/1985 | Eklund | 144/357 |

FOREIGN PATENT DOCUMENTS 1223539 6/1987 Canada .

*Primary Examiner*—W. Donald Bray
*Attorney, Agent, or Firm*—Christie, Parker & Hale

[57] ABSTRACT

A system of optimizing the volume of boards that may be cut from a log provides for one surface of a cant to be cut with a curved or straight surface. This takes into account curved, tapered or straight logs. The system comprises a scanner positioned to scan the log and determine an optimum cut surface profile, a cutting head positioned to cut the top surface of the log, the cutting head having relative vertical movement to the top surface, a conveyor to convey the log passed the scanner and the cutting head, and a controller to control the relative movement of the cutting head in accordance with the signal from the scanner to produce the predetermined optimum cut surface profile for the top surface of the log.

17 Claims, 6 Drawing Sheets

PROCESS AND APPARATUS FOR OPTIMIZING VOLUME OF BOARDS CUT FROM A LOG

The present invention relates to optimizing the volume of boards that may be cut from a log regardless of the log shape. The log may be curved, straight, tapered or a combination of these shapes. A process and apparatus is provided to cut a three sided cant from a log with a top surface that may be curved, inclined or flat, dependant upon the shape of the log.

Description of the Prior Art

In the preparation of lumber, a log is positioned on a headrig and rotated by an operator. The rotation may be automatic and include a scanning system, but is usually manually controlled by an operator to provide the optimum position for log breakdown into boards and cants. The log advances on a conveyor, and side cutters cut flat surfaces on each side of the log to form a cant. In some headrigs flat top, bottom, or top and bottom surfaces may also be formed. Side boards may be cut from the sides of the cant depending on the size of the log and its specific purpose. The resulting cant, which may be a two, three or four sided cant, is then generally passed to a cant optimizer before passing to the gang saws for cutting into boards. In headrigs used today scanners may be provided to scan a log both in the plan view and the side view and produce signals which are used with a computer to position the side rolls, side cutting heads and the quad twin or single band mills for cutting side boards.

A full taper or half taper infeed may be provided at the commencement of the headrig, alternatively turning rolls may be provided to rotate the log to the optimum position. A conveyor chain typically of the type disclosed in Canadian Pat. No. 1,223,539 issued June 30, 1987 to Stroud et. al, may be used for conveying the log through the headrig assembly. This chain assembly, referred to as a spiked chain conveyor, has a series of spikes that hold the log and loading rolls are provided on top to push the log down to engage with the spikes in the chain.

Recent improvements in the cutting of cants and boards from logs has been addressed to curved or swept logs, also logs with tapered sections, to maximize or optimize the volume of boards that can be achieved from such logs. Two sided cants are processed through gang edgers or canters using mechanical systems to propel the cants in an arc to follow their natural sweep. Greater recovery of wood is achieved when boards are sawn on a curve. This results in percentage increases that are claimed to vary from 2 to 20 per cent depending on many factors. In addition by sawing boards on a curve, the lumber properties are improved since the wood is cut generally along the grain instead of across it. It has been found that curved boards cut in this manner straighten out during drying in the kiln without significant degrading occurring.

SUMMARY OF THE INVENTION

It is an aim of the present invention to provide an apparatus and process for cutting a center cant to optimize the wood content of the cant when it is cut into boards. It is a further aim to provide a method and apparatus of cutting a center cant that is already optimized and therefore eliminates the need and additional cost for a subsequent cant optimizer prior to sawing into boards.

It is a further aim of the present invention to provide a cant which may be cut from a curved or swept log, that has one curved face, tapered face, or flat face dependent upon the log, to optimize the wood obtainable from the cant so that the cant may subsequently be passed to the gang saws and either curved or flat boards of even thickness cut from the curved, flat or tapered surface of the cant.

There is a still further aim of the present invention, and that is to provide a headrig and canter which is automatic, and once a log has been set at the beginning of the headrig it is scanned and processed through the canter to optimize the boards obtainable from the log and also to store the shape of the cant in a computer memory so that each cant is positioned upon its arrival in the next sawing line such that the leading end is parallel to the saw lines. In this way an operator need only monitor the process and does not have to manually control the apparatus.

The present invention provides a process for optimized volume of boards cut from a straight, tapered or curved log, comprising the steps of scanning the log to determine optimum cut surface profile for one face, conveying the log passed a cutting head to cut the one face, and controlling the cutting head movement in a plane perpendicular to the log axis to produce the predetermined optimum cut surface profile for the one face.

In another embodiment there is provided a process of cutting a cant to optimize volume recovery from a log, comprising the steps of rotating the log for optimum recovery scanning the log to determine optimum cut surface profile for a top face, conveying the log passed a top cutting head to cut the top face, and controlling relative vertical movement of the top cutting head to produce the predetermined optimum cut surface profile for the top face of the log. In another embodiment the log is scanned vertically to determine position of side cutting heads located on each side of the log to cut flat side surfaces on the log with at least one flat side surface being continuous for the length of the log.

In a still further embodiment of the present invention there is provided an apparatus for cutting a cant to optimize volume recovery from a log, comprising scanning means positioned to scan the log, determine an optimum cut surface profile for a top face of the log and provide a signal representative of the predetermined optimum cut surface profile, cutting head positioned to cut the top surface of the log, the cutting head having relative vertical movement to the top surface, conveyor means to convey the log passed the scanning means and the cutting head, and means to control the relative vertical movement of the cutting head in accordance with the signal from the scanning means to produce the predetermined optimum cut surface profile for the top surface of the log.

DRAWINGS OF THE INVENTION

In drawings which illustrate embodiments of the invention:

Figure 1:
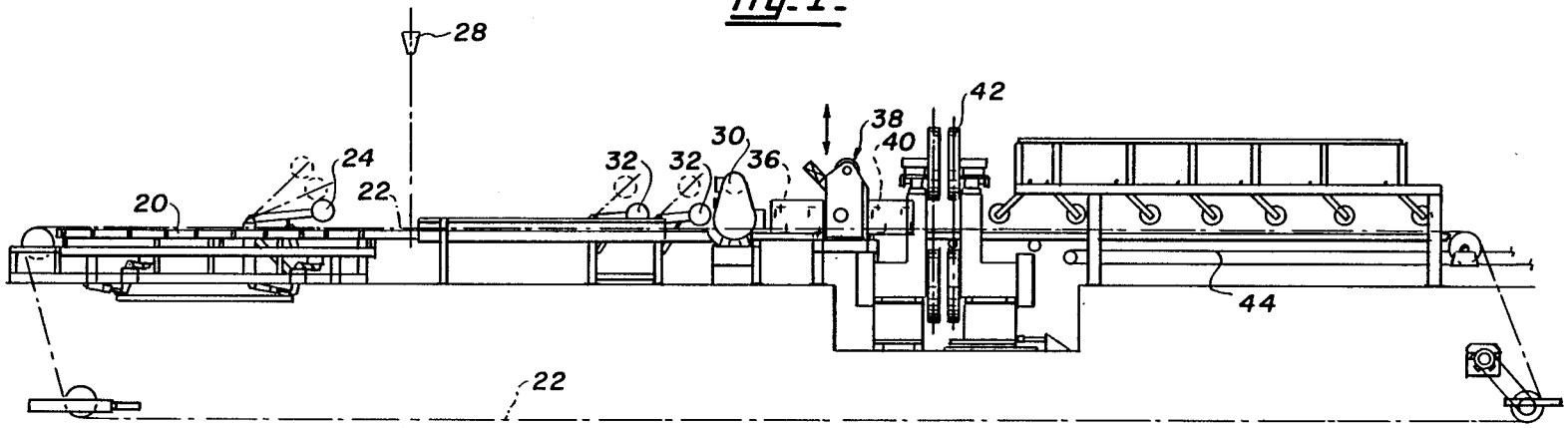
FIG. 1 is a side view of a three sided headrig and canter according to one embodiment of the present invention.
Figure 2:
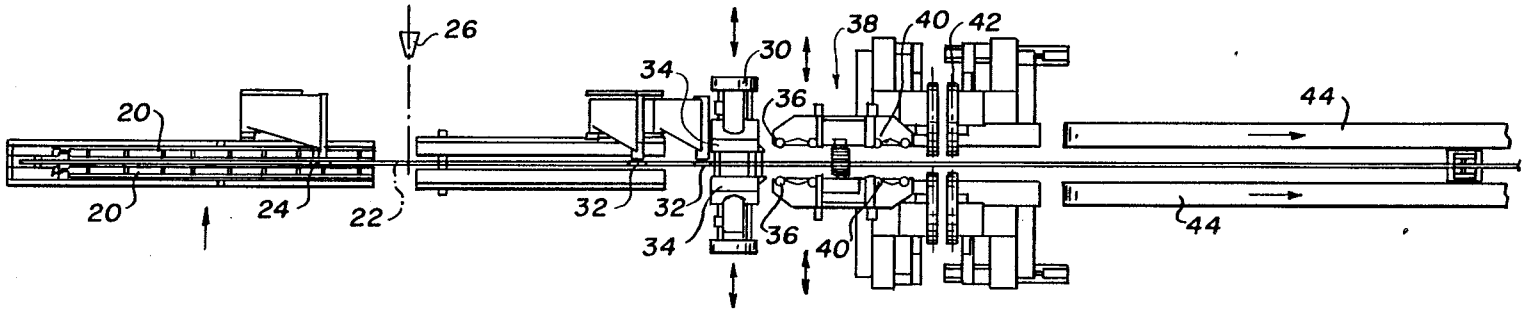
FIG. 2 is a planned view of the headrig and canter shown in FIG. 1.

Referring now to FIGS. 1 and 2, a three sided headrig and canter is shown with an initial set of turning rolls 20 to rotate a log positioned on a chain conveyor 22 which extends for the full headrig and canter. A thumper roll 24 pushes a log down to engage on the chain conveyor which is preferably of the type disclosed in my Canadian Pat. No. 1,223,539, and has spikes to hold and convey the log.

As the log advances on the chain 22 it is scanned in both the horizontal and vertical planes. A side scanner 26 scans the side of the log and it is the side scanner 26 that provides information to control the top cutting head. The top scanner 28 provides the horizontal plan of the log on the chain conveyor 22 for positioning the side cutting heads and side rolls.

The log is conveyed to a two side cutter unit 30, sometimes referred to as a two sided canter, to cut parallel flat faces on each side of the log. The faces are vertical and the log is held down by two hold down rolls 32. The two side cutting heads 34 of the side canter 30 can slide horizontally perpendicular to the chain conveyor, and the location of both heads 34 is dependent upon the signal from the scanner 28 which represents the plan of the log. Upon leaving the canter 30 the log is seized by side rolls 36, on one side the rolls are fixed and on the other are floating but apply a pressure to hold the log, depending upon which side of the log has a full face, either set of side rolls can be fixed with the alternate set being floating. The cant is passed under a top cutting head 38 followed by two more sets of side rolls 40. The log then passes through a quad band mill 42 or a twin band mill to cut side boards which fall off and are passed to an edger or edger optimizer on two separate conveyors 44. The three sided cant is then pushed off the chain conveyor 22 at the end of the headrig and is turned so that the top surface is now vertical and adjacent the tail bar of a subsequent cant breakdown machine center, either a twin or quad bandmill or gang edger, and is controlled by a lug deck. The cant is then ready for the next sawing line with the top face parallel to the saw lines.

Figure 3:
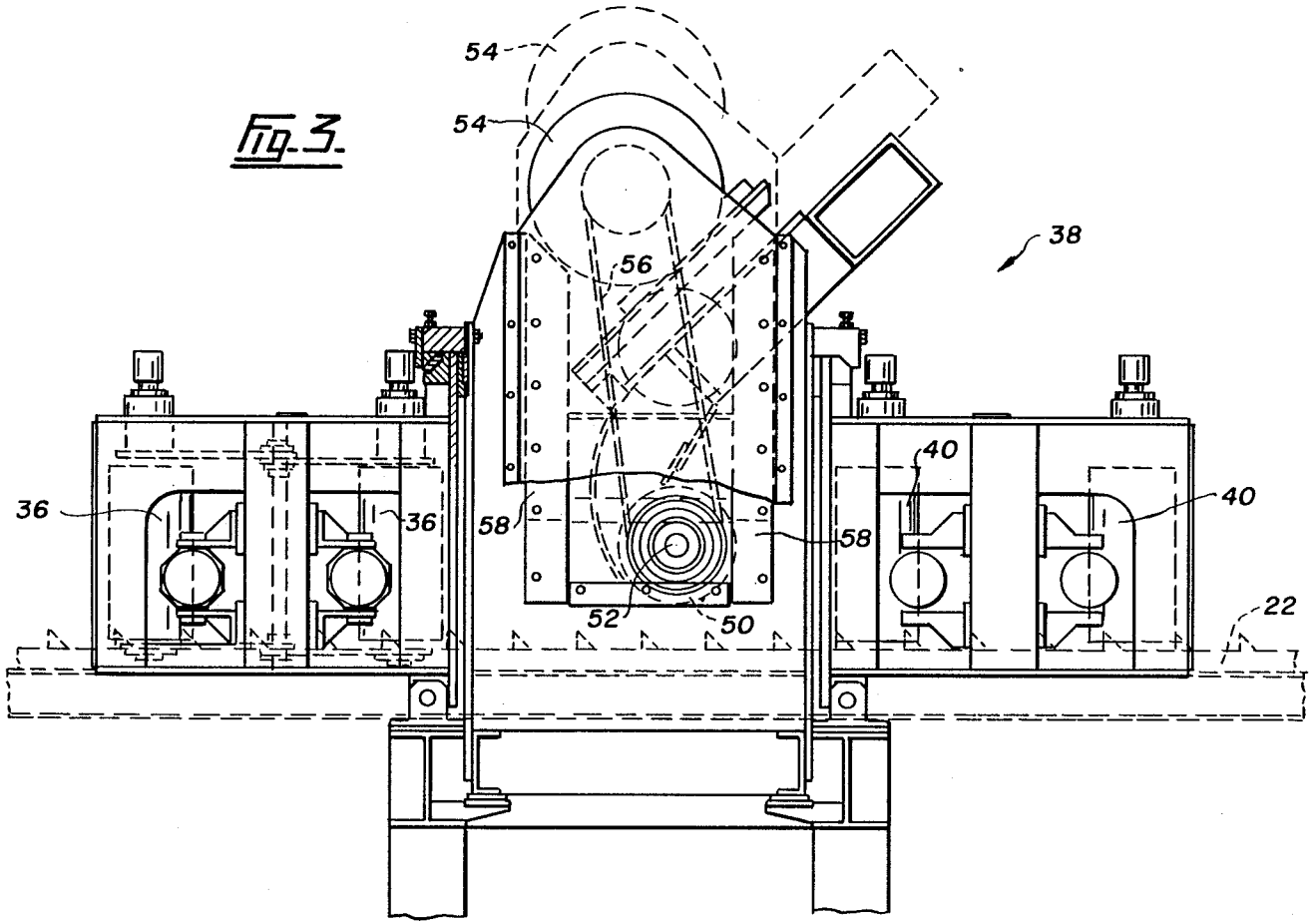
FIG. 3 is side view of a top cutting head suitable for the process and apparatus of the present invention.
Figure 4:
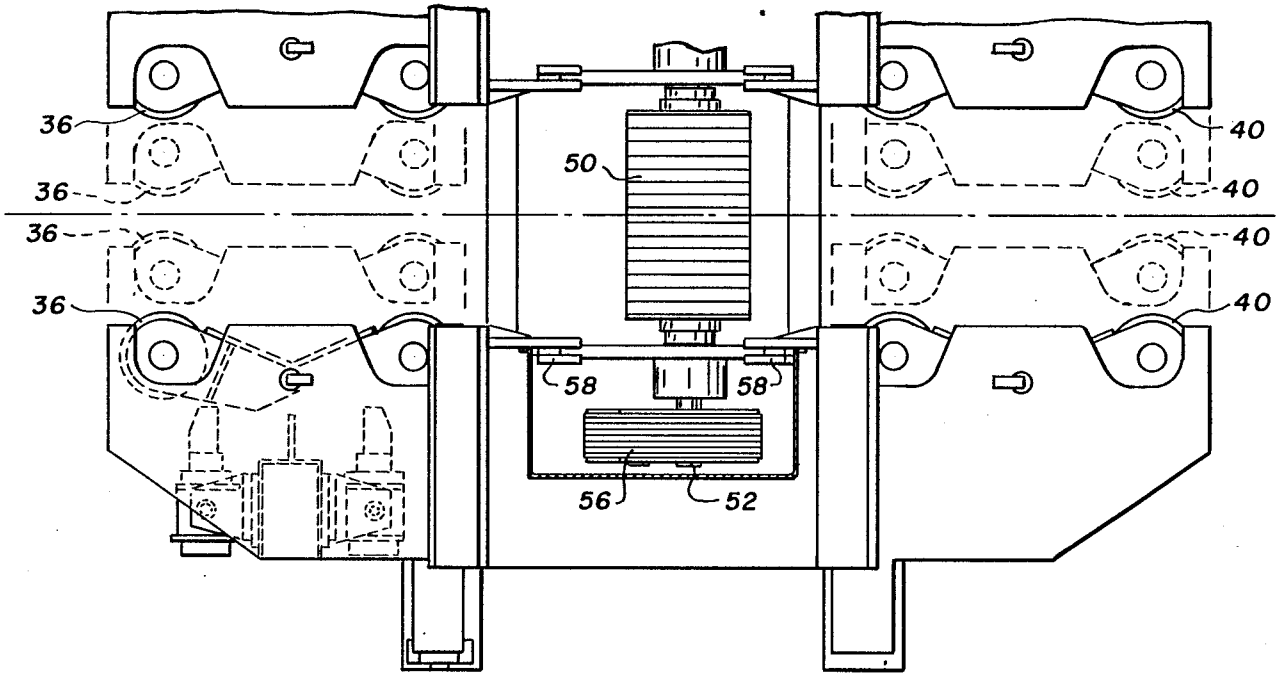
FIG. 4 is a partial plan view of the cutting head shown in FIG. 3.

The top cutting or chipping head 38 is shown in more detail in FIGS. 3 and 4. The chain conveyor 22 passes through the center of the unit and two leading pairs of side rolls 36 are positioned to receive a log and stabilize it on the conveyor 22 dependent upon the scan taken from the plan of the log. Because a log may be tapered or curved in the plan view it is preferred that one side of the log with a set of rolls 36 therein be a fixed side and in FIG. 4 the fixed rolls 36 and 40 are illustrated as being the top rolls. The lower rolls 36 and 40 are shown as being floating rolls and move backwards and forwards but retain sufficient pressure on the log to hold it in position while the top face is being cut. For the optimum solution, it may be that both side faces do not entirely clean up an opening face for the full length of the log. However in one embodiment the canter with the two side cutting heads 34 is arranged to cut one side face that is substantially continuous for the full length of a log. This continuous side face would be the one that rests against the fixed side rolls 36 and 40 which together act as a line bar for the log. However the fixed and floating rolls can change sides if the next log has the opposite side cut full length.

A cylindrical rotating cutter 50 with a horizontal axle 52 is driven by a motor 54 and belt drive 56 and the complete cutting assembly is moveable vertically in side guides 58, the movement is achieved by hydraulic cylinders (not shown) and control of the movement of the cutter 50 is based directly on a signal from the horizontal scanner 26 which scans the vertical axis of the log. The cutter head 50 moves in relationship to the speed of the conveyor 22 to cut the top face of the log to a predetermined profile, either curved, inclined or flat depending upon the scanning signal received from the horizontal scanner 26. Thus the cutter 50 moves up and down within guides 58 while a log is conveyed underneath it. The predetermined optimum cut surface profile for the top face is achieved in this manner.

Figure 6:
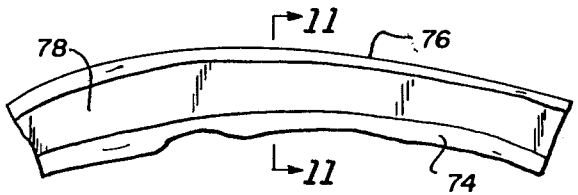
FIGS. 5 to 10 illustrate three different shaped logs and the different shaped cants that can be cut on the apparatus and process of the present invention.
Figure 8:
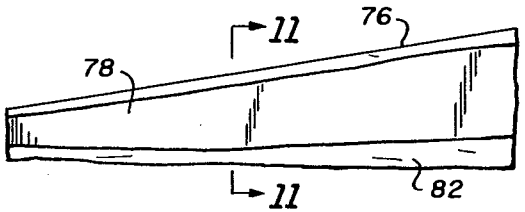
Figure 10:
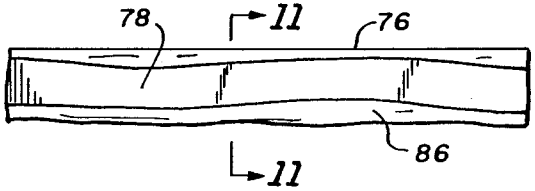
Figure 11:
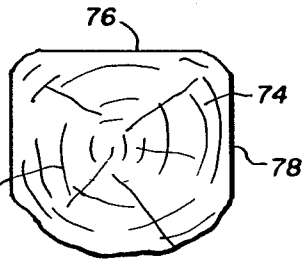
FIG. 11 is a sectional view of a cant taken at line 11—11 of FIGS. 6, 8 and 10.
Figure 5:
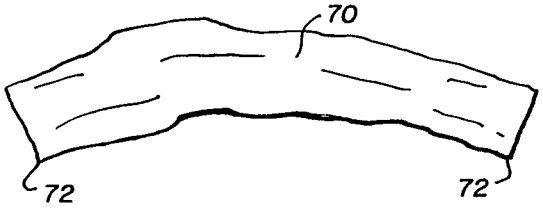
Figure 7:
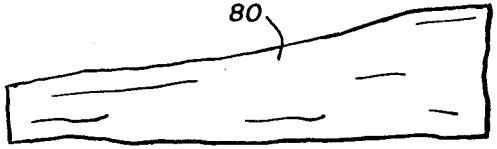
Figure 9:
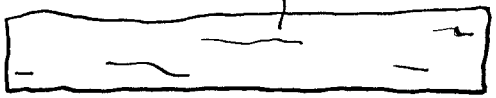

A curved or swept log 70 is illustrated in FIG. 5 with the horns 72 at the ends of the log 70 being positioned downwards. This is the arrangement preferred to obtain optimum volume of wood from a curved or swept log. FIG. 6 illustrates a three sided cant 74 cut from the log 70 with a cross section illustrated in FIG. 11. The cant 74 has a top curved surface 76 and two flat sides 78 to form a three sided cant. The top curved surface 76, which is convex, is the predetermined optimum cut surface profile of the log as determined from the scan of the vertical axis. FIG. 7 illustrates a tapered log 80 which is cut to a three sided cant 82 shown in FIG. 8. With full taper infeed a log of this shape has one full side face cut and fixed side rolls 36 act as a line bar for the full side face, the opposite side rolls float and act as press rolls to hold the log in position under the top cutting head 38. FIG. 9 illustrates a substantially straight log 84 cut to a substantially straight cant 86 as shown in FIG. 10. The cants 82 and 86 as shown in FIGS. 8 and 10 both have substantially flat surfaces, but these profiles may be curved dependent upon the signal from the horizontal scanner 26.

Figure 12:
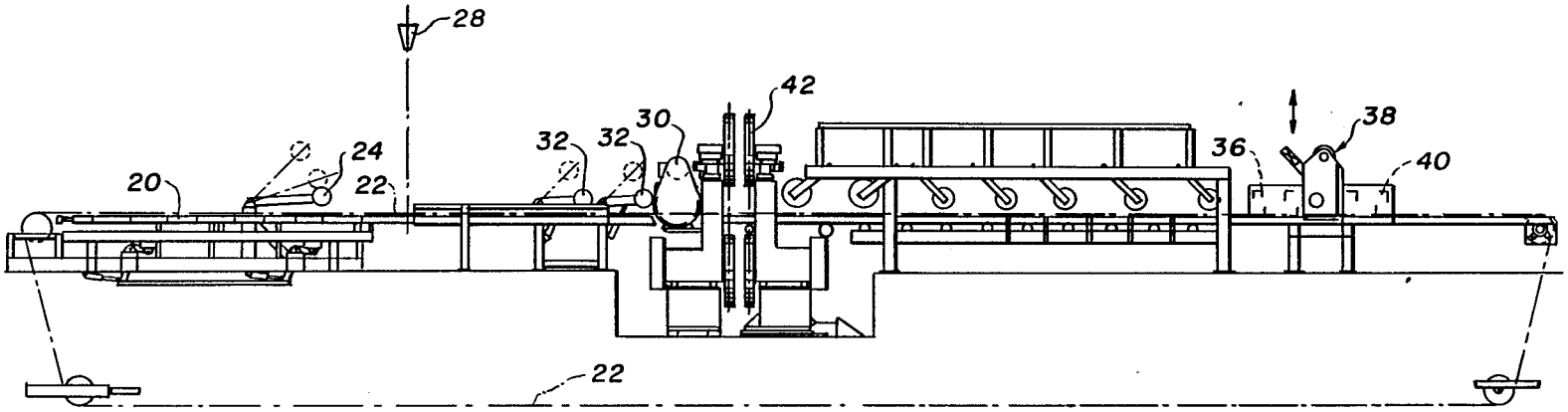
FIG. 12 is a side view of a three sided headrig and canter according to another embodiment of the present invention.

Another embodiment of a headrig and canter is illustrated in FIG. 12 wherein the top cutting head 38 is shown positioned after the band mill 42, such an arrangement is preferable for attachment to existing headrigs and canters.

Figure 13:
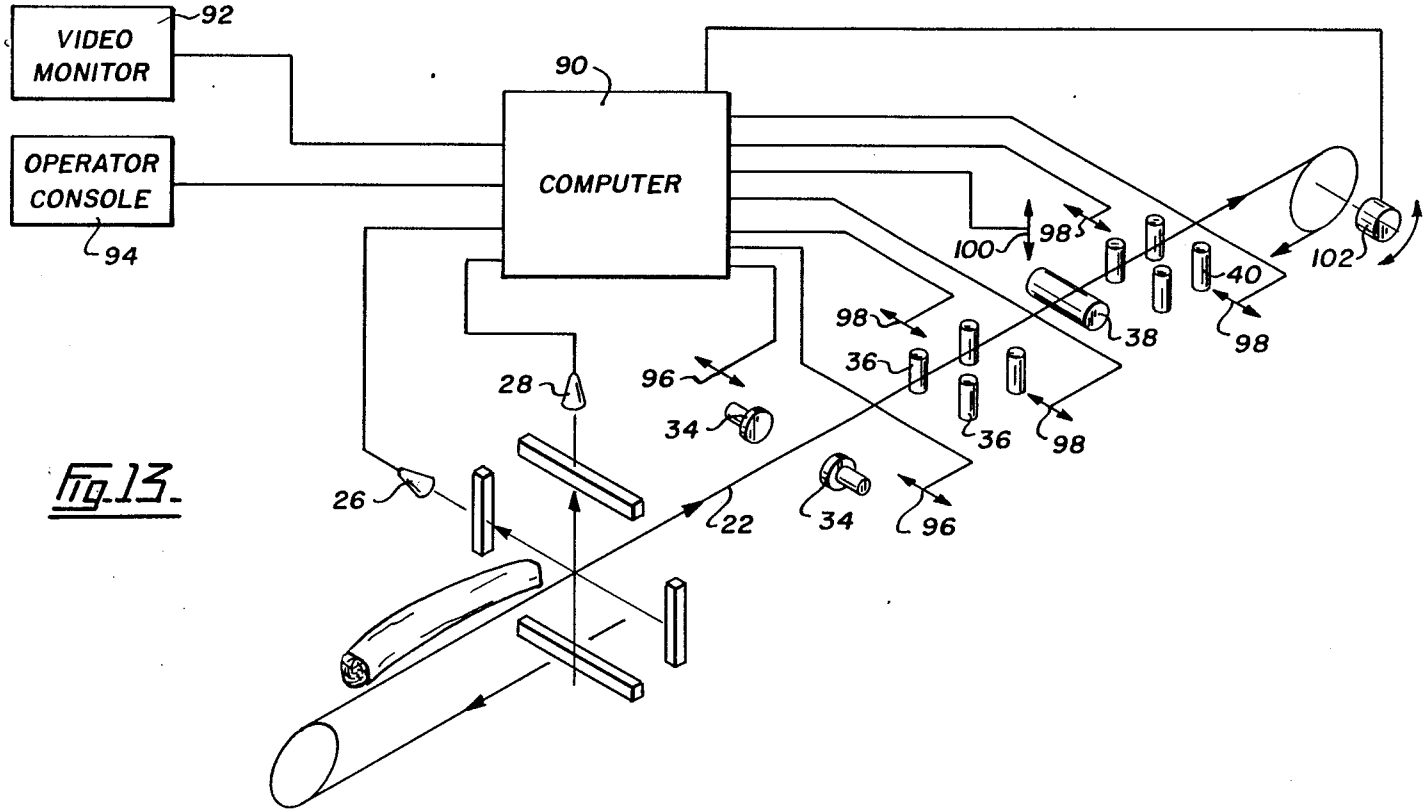
FIG. 13 is a block diagram illustrating the control system suitable for the headrig and canter according to the present invention.

FIG. 13 is a block diagram illustrating the control system. The vertical scanner 28 and horizontal scanner 26 makes vertical and horizontal scans of each log at present distances dependent upon the conveyor speed. The scans give horizontal diameter, and the horizontal offset from the center of this diameter, and vertical diameter and the vertical offset from the center of this diameter. The new scanning data is smoothed in a computer 90.

The scanned image in the vertical plane is examined to obtain critical measurements for the board fit boundaries, cant fit boundaries, chip depth boundaries and length. These boundaries, which for the sides have to be flat, determine the clean up of one face with the minimum wood removal and the other face chosen to be furthest from the center of the conveyor. The top surface, resulting from the horizontal scanner 26, takes into account any sweep or curve in the log. The top face is calculated to produce the maximum number and length of boards for the cant in a subsequent sawing operation, and may be curved, straight or tapered.

Sawing solutions for a cant are selected by the mill operator from a priority matrix shown on a video monitor 92. The operator then selects his preferred board sizes from a console 94. The computer 90 controls the sideways movements of the two side cutting heads 34 by infinitely variable linear positioners 96 with a feed back device.

The movement of the side rolls 36 and 40 on each side of the cutting head 38 are also controlled by infinitely variable linear positions 98 with feed back devices. The computer 90 provides a signal to an infinitely variable vertical linear positioner with a feed back device 100 to control the vertical movement of the top cutting head 38. A chain conveyor position feed back device 102 is provided for control of the speed of the chain conveyor 22.

The shape of each cant coming off the headrig is recorded in the computer memory, and specifically the top surface of the cant, so that when each cant is subsequently fed to the saw lines it is positioned upon its arrival such that its leading end is parallel to the saw lines and feed rolls process the cant through the saws following the surface, be it curved, tapered or straight. In the case of the quad sawing a curved cant, the rear two saw bands would set slightly further away from the line bar in order to cut constant thickness boards.

Various changes may be made to the embodiments disclosed herein without departing from the scope of the present invention which is limited only by the following claims.

I claim:

1. A process for optimizing the volume of boards cut from a straight, tapered or curved log, comprising the steps of:

scanning the log to determine the optimum cut surface profile for a horizontal face, conveying the log past a cutting head to cut the said face, and controlling the cutting head movement in a plane perpendicular to the log axis to produce the predetermined optimum cut surface profile for the said face.

2. The process according to claim 1 including the step of sawing the log with saw lines evenly spaced from the predetermined optimum cut surface profile of the face to provide boards of constant thickness.

3. A process of cutting a cant to optimize volume recovery from a log wherein said horizontal face is the top face, comprising the steps of:

scanning the log to determine optimum cut surface profile for the top face, conveying the log past a top cutting head to cut the top face, and controlling relative vertical movement of the top cutting head to produce the predetermined optimum cut surface profile for the top face of the log.

4. The process according to claim 3 wherein the optimum cut surface profile for the top face is selected from the group consisting of a curved face, an inclined face and a flat face, the selection being determined from scanning the log.

5. The process according to claim 3 including the steps of scanning the log horizontally to determine the predetermined optimum cut surface profile for the top face, and scanning the log vertically to determine position of side cutting heads located on each side of the log to cut flat side surfaces on the log with at least one flat side surface being continuous for the length of the log.

6. The process according to claim 5 wherein the position of the log is maintained while being conveyed after the side cutting heads and before the log passes under the top cutting head.

7. The process according to claim 5 including the step of cutting side boards from the cant after passing the side cutting heads and the top cutting head.

8. The process according to claim 5 including the step of cutting side boards from the cant after passing the side cutting heads and before the top cutting head.

9. The process according to claim 5 including the steps of turning the cant and sawing the cant with saw lines evenly spaced from the predetermined optimum cut surface profile of the top face to provide boards of constant thickness.

10. The process according to claim 5 wherein the log is conveyed on a chain conveyor for scanning and cutting to form a cant.

11. An apparatus for cutting a cant to optimize volume recovery from a log, comprising:

scanning means positioned to scan the log for determining an optimum cut surface profile for a top face of the log and providing a signal representative of the predetermined optimum cut surface profile, a cutting head positioned to cut the top surface of the log, the cutting head having relative vertical movement to the top surface, conveyor means for conveying the log passed the scanning means and the cutting head, and means for controlling the relative vertical movement of the cutting head in accordance with the signal from the scanning means to produce the predetermined optimum cut surface profile for the top surface of the log.

12. The apparatus for cutting a cant according the claim 11 wherein the scanning means scans in two directions, from the side to determine the optimum cut surface profile for the top face of the log and from the top to determine position of the log for side cutting.

13. The apparatus for cutting a cant according to claim 12 including side cutting heads to cut flat side surfaces on each side of the log.

14. The apparatus for cutting a cant according to claim 11 wherein the scanning means selects the predetermined optimum cut surface profile for the top face and produces a signal representative of the top face selected from the group consisting of a curved face an inclined face and a flat face.

15. The apparatus for cutting a cant according to claim 11 including a rotating means prior to the scanning means to rotate the log for optimum scan.

16. The apparatus for cutting a cant according to claim 12 including side rolls located on each side of the conveyor means on each side of the cutting head, the side rolls on one side being fixed and on the other side being floating, the side rolls being positioned for each log in accordance with a signal from the scanning means determining the positioning of the log for side cutting.

17. The apparatus for cutting a cant according to claim 12 including band mill cutting means after the side cutting heads for cutting side boards from each side of the log.

* * * * *